United States Patent [19]

Patterson

[11] 4,193,176

[45] Mar. 18, 1980

[54] MULTIPLE GRID FABRICATION METHOD

[75] Inventor: Matthew Patterson, Torrance, Calif.

[73] Assignee: Hughes Aircraft Company, Culver City, Calif.

[21] Appl. No.: 956,010

[22] Filed: Oct. 30, 1978

[51] Int. Cl.[2] ..... H01J 9/14

[52] U.S. Cl. ..... 29/25.14; 29/25.16; 29/25.18; 228/159; 228/161

[58] Field of Search ..... 29/25.14, 25.15, 25.16, 29/25.18, 423; 228/159, 162, 160, 161, 185, 189, 190

[56] References Cited

U.S. PATENT DOCUMENTS 3,152,939 10/1964 Borneman et al. ..... 29/423 X 3,315,330 4/1967 Hisada ..... 29/423 X

*Primary Examiner*—Richard B. Lazarus

*Attorney, Agent, or Firm*—Rafael A. Cardenas; W. H. MacAllister

[57] ABSTRACT

A method of fabricating an improved multiple grid electrode having a plurality of discs by simultaneously forming a dimpled segment in a sandwich structure consisting of metallic discs separated by spacer material. The dimpled sandwich structure is then machined, forming a series of vanes on the dimpled portion by an appropriate method, such as electrical discharge. After machining, the spacer material is etched away, leaving only the vaned discs, forming grid electrodes.

3 Claims, 8 Drawing Figures

MULTIPLE GRID FABRICATION METHOD

The Government of the United States of America has rights in this invention pursuant to Contract No. F33615-77-C-5067 awarded by the Department of the Air Force.

BACKGROUND OF THE INVENTION

1. Field of the Invention

The invention relates generally to electron guns and in particular to a method of fabricating a multiple gride electrode.

2. Description of the Prior Art

Electron guns are well known in the prior art, especially those electron guns utilized to generate an electron beam in traveling wave tubes (TWT). The present technology of traveling wave tubes may be generally divided into two types, either continuous wave (CW) mode or pulsed mode. There are some multi-mode TWTs which operate both as CW mode or pulsed mode and at various power levels. The pulsed and multi-mode TWT requires a more complex electron gun for its operation.

The electron gun used with a single mode CW TWT usually requires only a heater, a cathode and an anode within a vacuum envelope. Once the electron gun is turned on, the TWT operates at a single beam diameter and at a constant power level.

Continuous mode TWTs operate at a generally lower power level than the pulsed or multi-mode TWTs. For example, a pulsed TWT is capable of operating at power levels which are an order of magnitude greater than the same TWT operating in the CW mode.

A pulsed TWT requires additional structure, such as a control grid within the vacuum envelope of the electron gun. The control grid is a dish-shaped electrode having the same center of curvature as that of the cathode face. A small space, on the order of 0.003 inch, separates the control grid from the cathode face. The face of the control grid may have a symmetrical design composed of a series of thin vanes to allow the electron beam to pass through the grid as unobstructed as possible. The control grid is employed to interrupt the current flow, thereby turning the electron beam on and off, thus pulsing the TWT. To regulate the beam, a suitable positive potential, such as +400 volts above the cathode voltage, is applied to the control grid during the "on" period. To turn the electron beam "off", an appropriate negative potential, such as −400 volts below the cathode potential, is applied.

Sometimes another grid, called the shadow grid, is used in conjunction with the control grid. The shadow grid is interposed between the control grid and the cathode electrode and is maintained at the same potential as the cathode electrode. The shadow grid has the same configuration as the control grid. Its function is to form a shadow or shield for protecting the control grid, or any other associated grid, from receiving the "high interception current" from the electron beam. If the electron beam strikes the control grid or other subsequent grids, a high current will flow, thereby causing heating problems in that grid. If the control grid draws current from the electron beam, operating efficiency will be reduced. For the shadow grid to function properly, its structure must be the same as that of the control grid and both must be in perfect alignment.

In a dual mode TWT, i.e., operating at two power levels such as CW and pulsed mode, a third grid electrode, called a screen grid, is also used to control the electron beam. The screen grid is generally positioned between the shadow grid and the control grid and is separated from both of them by as small a distance as possible, depending on the operating voltages. Generally the separation distance is on the order of 0.003 inch. This grid electrode essentially regulates the diameter of the electron beam. By applying the proper negative voltage, relative to the cathode potential, such as −200 volts, a small electron beam is formed for CW operation. The electrical potential on the screen grid may be varied to control the beam current also. A positive voltage, relative to the cathode electrode, allows a much larger beam to be formed, i.e., more power, and the TWT can operate in the pulsed mode.

As is evident, the structure of the electron gun generally, and the grids in particular, determine the type of TWT (pulsed, CW, or multimode).

In TWTs requiring multiple grids, the alignment of those grids as well as the inter-grid separation determines to a great extent the operating characteristics of the TWT. Each of the grids has a vaned structure which is identical in shape to the other grids. The size and shape of grids are extremely important to the operating characteristics of the TWT. Also, the alignment of the individual vanes must be as precise as possible so that the second and third grids do not intercept the electron beam and draw energy away from it. The inter-grid spacing is also extremely important, since the greater the separation from the preceding grid the greater the voltage required on the succeeding grid to operate with consistent voltages gun to gun. Thus, the electrical characteristics would vary from one TWT to another if the spacing between grids were not maintained, making it impossible to predict electrical performance for a given TWT.

Current practice for fabricating grid electrodes for electron guns is to form each one individually. A single disc of molybdenum is placed on a press and a spherical dimple is formed. A vaned structure is then machined through the dimpled portion of the disc. Machining may be by the electrical discharge method or by photoetching. Electrical discharge uses an electric arc to erode, or etch away, the unnecessary material from the disc, thereby leaving the desired vaned structure. After all the necessary grids have been fabricated, the grids are brazed onto their respective support members. The grid and support members are assembled, with ceramic and metallic spacers inserted between the grids. The entire assembly is aligned so that the grids are coaxial and so that the vanes of each of the grids overlap as nearly as possible. Generally, a ceramic pin is inserted through holes in the grids to keep them aligned.

The prior art process just described has many limitations. For example, the grids are generally not identical, since they are individually fabricated. If the dimples are not perfect then the requisite interdisc spacing cannot be maintained, thereby affecting the voltage requirements. Since the vanes are individually machined, they are normally not uniform and therefore are usually not in perfect alignment, thereby affecting the beam current. It is extremely difficult to etch identical vanes in different grids because the finished vanes are typically 0.001–0.002 inches wide. In addition, since each grid is individually formed, labor costs are high.

SUMMARY OF THE INVENTION

Accordingly, it is an object of the present invention to provide a more economical and accurate method of fabricating grid electrodes.

It is still another object of the present invention to provide improved grid electrodes for use in an electron gun.

It is yet another object of the present invention to provide a TWT having more predictable characteristics.

In accordance with the foregoing objects, a method of simultaneously fabricating a plurality of grid electrodes includes the steps of assembling at least first and second discs on either side of a spacer having a predetermined thickness; simultaneously brazing the discs to their respective support members; simultaneously forming dimples in the assembled discs; simultaneously machining the vaned structure on the discs and removing the spacer material.

DETAILED DESCRIPTION OF THE DRAWINGS

Figure 1:
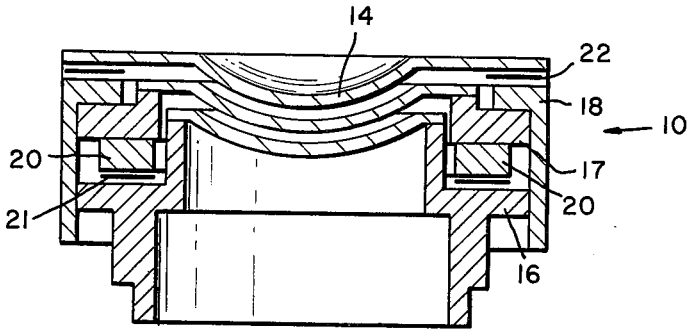
FIG. 1 is a cross-section view illustrating a prior art electron gun grid assembly.

Referring now more specifically to the figures, FIG. 1 illustrates a prior art electron gun structure 10 composed of a plurality of parts, some of which require precise dimensions. First and second grids 12 and 13 are each individually brazed to their respective first and second metallic mounting supports 16 and 17. Between the first and second mounting supports are a ceramic spacer ring 20 and a metal shim 21. These two parts, 20 and 21, are required to provide the proper separation between the two grids 12 and 13. A metal shim 22 and ceramic spacer 18 are disposed between the grids 13 and 14 for providing clearance between these grids.

The process by which this prior art device is assembled is lengthy and complex. The various support members, ring and shims must be manufactured to precise tolerances. The three grids blanks 12, 13 and 14 are separately and individually dimpled, also to close tolerances. Two of the three grid blanks (12 and 13) are brazed to their respective support members (16 and 17). Then each grid blank is individually machined by the electric discharge method. After all parts have been prepared, the parts are assembled, which may require as much as 16 hours to properly align all the vanes of the individual grids. Even after such an extensive time expenditure, some electron guns fail to meet operating specifications, due to the accumulation of tolerances. A less costly, more accurate and reliable assembly method has been devised to overcome these limitations of the prior art.

Figure 2:
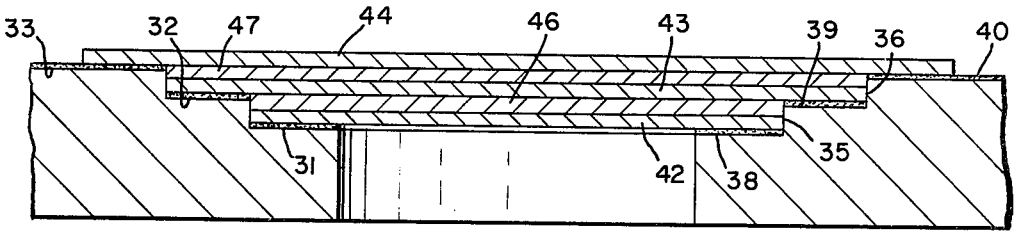
FIG. 2 is an edge view of first, second and third grid blanks and two spacers on a ceramic support.

A preferred embodiment of the invention will now be described with reference to FIG. 2. An annular ceramic support member 30 has metallized surfaces 31, 32 and 33. The metal for the metallized surfaces may be copper or any other suitable material which has been deposited on the designated surfaces. The metallizing material must be compatible with the grid material, which is normally molybdenum. A first brazing form 38 is placed into a first counterbore 35 within the ceramic support 30. The brazing form may be in the shape of a washer 38 having a thickness of 0.001 inch. As the workpiece is heated, the washer melts and wets the surfaces of both the metalized surface 31 and the grid blank 42, thereby bonding them together. The brazing material may be an alloy of 50% copper and 50% gold. The grid blank 42 is placed into the first counterbore diameter 35 over the brazing form 38 which in turn is on top of annular metallized surface 31. The grid blank 42 may be 0.003 inch thick. A first disc shaped metallic spacer 46 is then placed over the grid blank 42. The first metallic spacer 46 may be made of iron, stainless steel or other suitable material having a thickness of 0.003 inch, depending upon the separation desired.

A second brazing form, shown here as a 0.001-inch thick washer 39, is placed into the second counterbore 36. A second grid blank 43, having a slightly larger diameter than blank 42 and made of the same material, is placed over the brazing washer 39. A second metallic spacer 47 similar to the first spacer 46 is placed over the second blank 43.

A third brazing form, illustrated as a 0.001-inch thick brazing form 40, is centered over the metallized surface 33, and a third grid blank is coaxially aligned with the first two grid blanks. This third blank 44 is similar to the other two blanks and has a slightly larger diameter than the second blank 43.

The entire sandwich structure and ceramic support member 30 are placed in an oven at 1000° C. for several minutes to braze the grid blanks to the support 30. The time and temperature depend upon the brazing medium as well as the material being brazed. The temperature and time herein described have been found suitable for the materials and thicknesses hereinabove mentioned.

Figure 3:
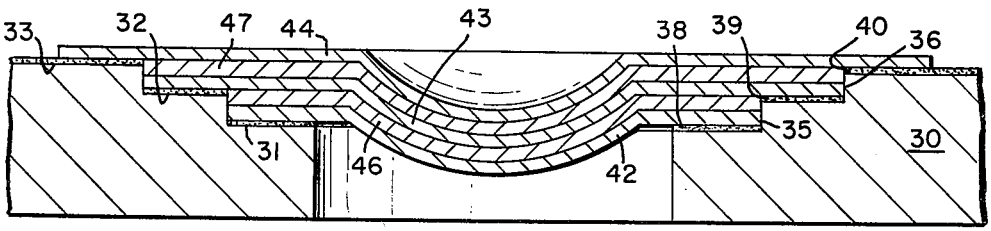
FIG. 3 is a cross-sectional view of first, second and third blanks and spacers after forming dimples therein.

After the brazed assembly has cooled, a spherical dimple is formed simultaneously from the upper surfaces of the grid blanks, as illustrated in FIG. 3. An elliptical dimple may also be formed instead. The depth of the dimple as well as its shape depend on the optical requirements of the electron gun. These factors will not be discussed here as they are not the subject of the present invention. The dimple will be formed by appropriate forming tools. By simultaneously forming dimples in the three grid blanks with one tool, the three are maintained uniformly spaced by their spacer material, and with their dimples in alignment.

Figure 4:
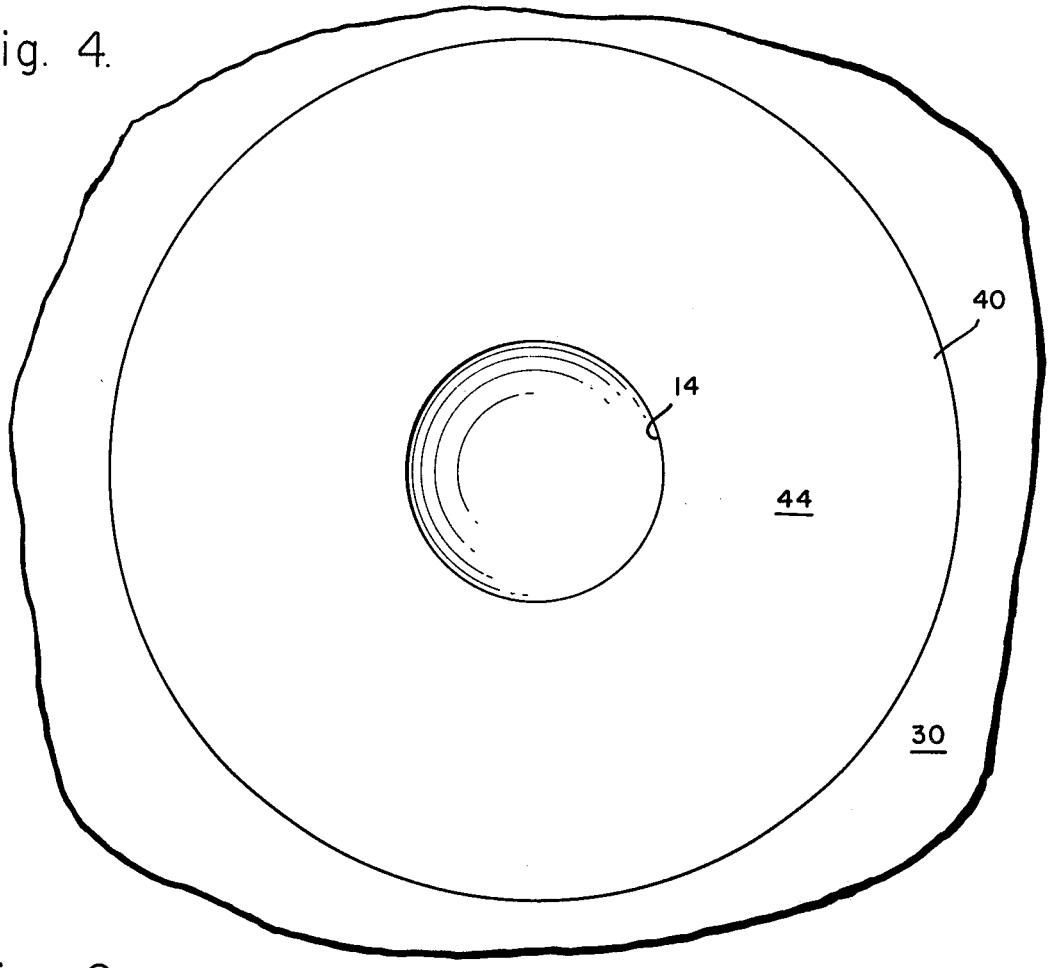
FIG. 4 is a plan view of a dimpled sandwich structure according to FIG. 3.

FIG. 4 illustrates, in plan view, the dimples formed in the grid blanks. The tool used to form the dimples may be constructed so that the outer diameter of the tool rests against the flat portion of the blanks, holding them fast during the dimpling process. During the dimpling operation, pressure should be applied to hold the grid blanks tightly to the ceramic support so that the blanks are not pulled away from their brazed joints.

Figure 5:
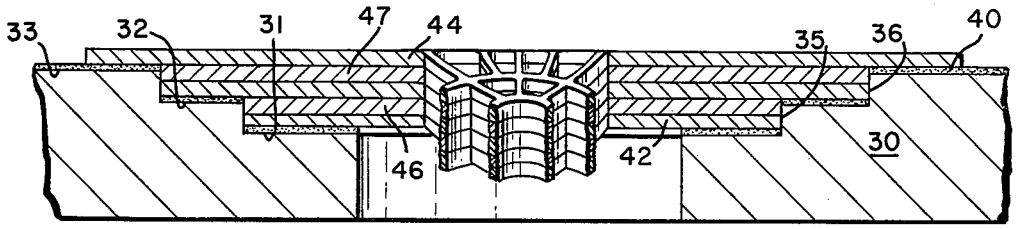
FIG. 5 is a cross-sectional view of first, second and third discs and spacers after machining.

FIG. 5 is a cross-sectional diagram of the sandwiched structure which has been machined by the electrical discharge method in accordance with the present invention. The electrical discharge method, or Elox as it is known by its tradename, utilizes a die which is the negative of the vaned structure of the grid. The piece to be etched is placed in a de-ionized solution, such as water, and held in place. An electrical potential is placed on the die and it is lowered against the face of the grid. As the charged die approaches the workpiece, an electrical discharge is established between the two and the grid is etched away. As the material is is etched, the die gradually penetrates into the sandwich structure until all the grid blanks and spacers are etched through.

The simultaneous machining of the grid structure guarantees that all three grids are etched to almost the identical dimensions and that they are in precise alignment, since they are etched in unison. Even if the tool is not in perfect coaxial alignment with the workpiece, all the vanes will still lie directly over one another. This multilayered structure also saves time and expense, since all three grids are machined at one time, thus eliminating two additional machining operations.

Figure 6:
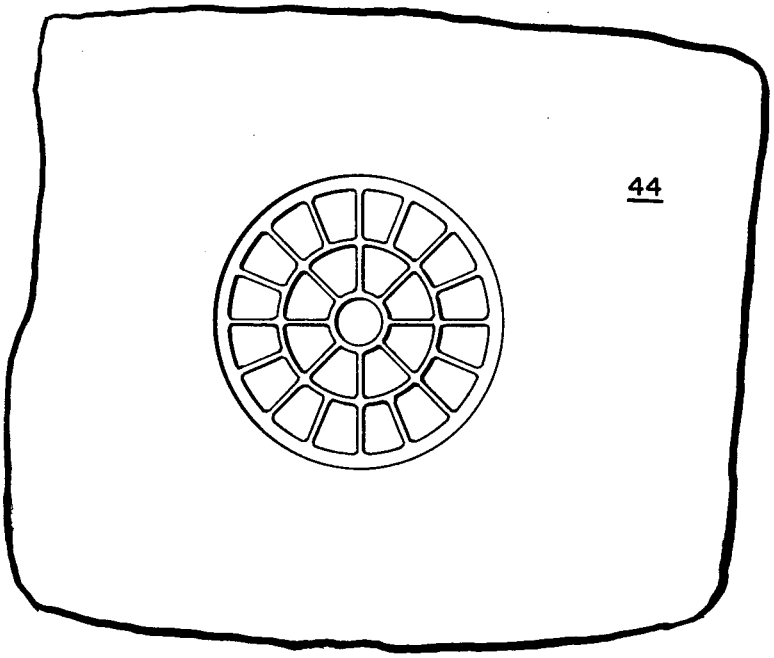
FIG. 6 is a plan view of first, second and third grids after machining according to FIG. 5.

FIG. 6 illustrates the grid electrode after the grid blank has been etched. A typical grid structure having the vaned pattern of the figure has a diameter across the vaned area of 0.2 inches. The width of the vanes is in the range of 0.002–0.003 inches (after machining and before polishing). As is evident, the grid structure is a very delicate design. After electropolishing, the vane widths are between 0.001 and 0.002 inches.

It is extremely important that the vane patterns of the multiple grids be aligned as closely as possible. The grids which are not aligned down stream in the electron beam will be subject to heating and in addition the optical characteristics will be affected. There will be electrons striking that portion of the grid which is exposed to the beam, causing high current to flow and thereby overheating the exposed grids. As was discussed above, the shadow grid is nearest to, and at the same potential as, the cathode. The shadow grid shields the other grids which are aligned with it against all but minimal beam current. Thus, it can be seen that grid alignment is extremely important since it affects the electron gun's characteristics which in turn affect the TWT's characteristics.

After the vanes have been formed, the sandwiched structure is ready for removing the spacer material, leaving only the grids as illustrated in FIG. 6. The spacer is etched away from between the grids while in a sulphuric acid solution or other suitable acid. The etchant may be any solution to which the grid material and the ceramic support are impervious but which will dissolve the spacer material. The temperature and etching time may vary, depending upon the spacer material and the etchant, and is not the concern of the present discussion.

The machining process leaves burrs and sharp edges on the vanes. To remove these defects the grid structure may be chemically etched or electro-polished. As is well known, electro-polishing is accomplished by applying a potential to the grid and submerging it in a solution containing an electrolyte of a suitable salt. The resulting arcing from the sharp corners and burrs removes them, leaving a smooth surface.

Figure 7:
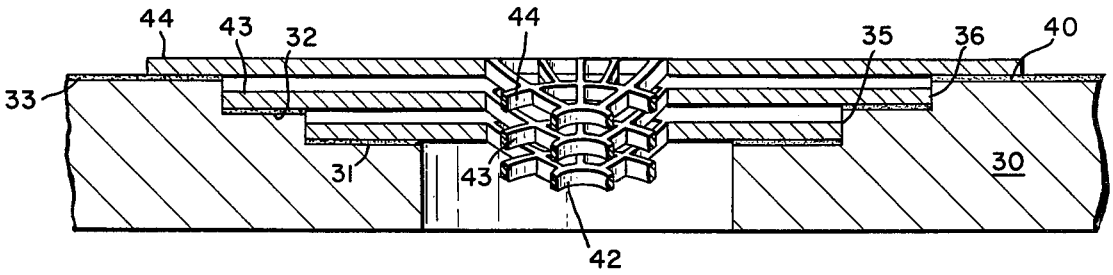
FIG. 7 is a cross-sectional view of a grid structure after the spacer material has been etched away.

Briefly, FIG. 7 illustrates the grid electrodes in cross-section, after the spacers have been etched away. As is clearly illustrated, the grid electrodes are uniformly spaced apart after the spacer material has been etched away. It is this uniform spacing, and the fact that this particular structure may be easily duplicated, which permits predictable electrical characteristics for all electron guns fabricated by the present technique.

Figure 8:
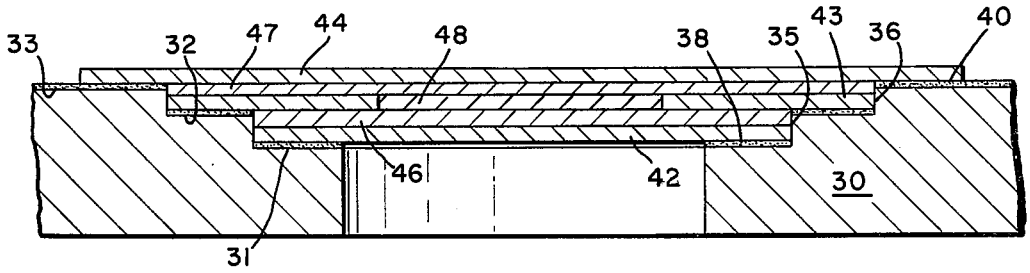
FIG. 8 is a cross-sectional view illustrating the formation of a grid system including a screen grid.

Heretofore, the general theory or concept of the process according to the present invention has been discussed in detail. FIG. 8 illustrates a particular device during an intermediate stage of its fabrication in accordance with the inventive process. Generally, a dual mode or multimode TWT requires an electron gun which is capable of producing at least two beam diameters. In order to produce the two beam diameters, a screen grid is usually utilized. The physical configuration of this screen grid is different from that of the other grids in that a circular center portion of the grid is removed, leaving only an outer portion which has a vane structure identical to that of the other grids. In operation, to produce a small diameter electron beam, a negative potential is applied to the screen grid. That portion of the vaned structure which remains after the central portion has been removed, blocks the outer portion of the electron beam, leaving only a smaller diameter beam. Thus, the tube would operate in the low power CW mode. To produce a high power electron beam such as in the pulsed mode, a positive potential is applied to the screen grid to form a larger diameter beam which passes through both the vaned portion of the screen grid and through its smaller center portion.

FIG. 8 illustrates the fabrication method of the screen grid. The central portion of the screen grid blank 43 is removed before assembling into the sandwich structure. In that center portion's place, an etchable spacer 48 is substituted. The remainder of the grid sandwich is assembled and processed as outlined above.

Although the invention has been shown and described with reference to particular embodiments, nevertheless, various changes and modifications obvious to one skilled in the art to which the invention pertains are deemed within the purview of the present invention.

What is claimed is:

1. An improved method of fabricating grid electrodes, comprising the steps of:
   - metallurgically bonding a plurality of grid blanks separated by spacer discs onto a support member to form a sandwich structure;
   - forming a dimple in said sandwich structure;
   - machining a predetermined grid pattern through said sandwich structure in a single step; and
   - removing said spacer discs so as to leave a plurality of spaced apart, uniformly patterned, dimpled grids.

2. An improved method of fabricating grid electrodes, comprising the steps of:
   - assembling a composite structure comprised of alternating blank discs and spacer discs;
   - placing said composite structure on the metallized surface of a support member;
   - brazing said composite assembly to said support member;
   - forming a dimple in said composite assembly in a single operation;
   - machining said composite assembly; and
   - removing said spacer discs by etching.

3. An improved method of fabricating grid electrodes comprising the steps of:
   - placing a first grid blank onto a support member;
   - placing a spacer disc over said first grid blank;
   - placing a second grid blank over said spacer disc;
   - brazing said first and second grid blanks to said support member;
   - simultaneously forming a dimple in said first and second grid blanks;
   - machining a predetermined uniform grid pattern in said first and second grid blanks and in said spacer disc; and
   - etching away said spacer disc.

* * * * *